US007454889B2

(12) United States Patent
Biermann et al.

(10) Patent No.: US 7,454,889 B2
(45) Date of Patent: Nov. 25, 2008

(54) METHOD FOR PRODUCING AN EFFECT YARN ON AN OPEN-END ROTOR SPINNING MACHINE, AND CORRESPONDING EFFECT YARN

(75) Inventors: Iris Biermann, Mönchengladbach (DE); Wolfgang Doerner, Mönchengladbach (DE); Christoph Haase, Viersen (DE); Lorenz Kreitzen, Rheinberg (DE); Ralf Siewert, Schwalmtal (DE)

(73) Assignee: Oerlikon Textile GmbH & Co. KG., Remscheid (DE)

( * ) Notice: Subject to any disclaimer, the term of this patent is extended or adjusted under 35 U.S.C. 154(b) by 69 days.

(21) Appl. No.: 10/580,125

(22) PCT Filed: Oct. 13, 2004

(86) PCT No.: PCT/EP2004/011449

§ 371 (c)(1),
(2), (4) Date: May 19, 2006

(87) PCT Pub. No.: WO2005/052231

PCT Pub. Date: Jun. 9, 2005

(65) Prior Publication Data

US 2007/0151224 A1 Jul. 5, 2007

(30) Foreign Application Priority Data

Nov. 21, 2003 (DE) ..... 103 54 608

(51) Int. Cl.
*D01H 4/48* (2006.01)

(52) U.S. Cl. ..... 57/404; 57/263

(58) Field of Classification Search ..... 57/22, 57/202, 263

See application file for complete search history.

(56) References Cited

U.S. PATENT DOCUMENTS

| | | | | |
|---|---|---|---|---|
| 4,825,632 | A * | 5/1989 | Raasch et al. | 57/264 |
| 5,509,261 | A | 4/1996 | Wassenhoven et al. | 57/263 |
| 6,035,622 | A | 3/2000 | Fox et al. | 57/263 |
| 7,082,746 | B2 * | 8/2006 | Brandl et al. | 57/263 |
| 2002/0073683 | A1 | 6/2002 | Zipperer | 57/261 |

FOREIGN PATENT DOCUMENTS

DE 40 30 100 A1 4/1992

* cited by examiner

*Primary Examiner*—Shaun R Hurley
(74) *Attorney, Agent, or Firm*—K&L Gates LLP

(57) ABSTRACT

A method for producing an effect yarn on an open-end rotor spinning machine, formed from an alternating line-up of yarn sections and effects consisting of pre-determined thickenings, wherein an effect is produced where the yarn is joined by means of a piecing end, in the piecing region of the yarn located downstream of the piecing end, following a break in the thread. The quality of the yarn produced in this way is improved such that unwanted deviations from the pre-determined repeat of pattern of the effect yarn, caused by piecing regions, are eliminated.

6 Claims, 2 Drawing Sheets

METHOD FOR PRODUCING AN EFFECT YARN ON AN OPEN-END ROTOR SPINNING MACHINE, AND CORRESPONDING EFFECT YARN

CROSS-REFERENCES TO RELATED APPLICATIONS

This application claims the benefit of German patent application 10354608.1, filed Nov. 21, 2003, herein incorporated by reference.

BACKGROUND OF THE INVENTION

The invention relates to an effect yarn which is formed from an alternating line-up of webs and effects consisting of predetermined thickenings and to a method for producing such an effect yarn on an open-end rotor spinning machine, wherein the effect yarn is reconnected by means of a piecer after yarn interruptions.

During the production of yarn, as high a uniformity of the yarn as possible is generally aimed for within narrow tolerances. In contrast, for effect yarns, the non-uniformity of the yarn is characteristic. A yarn in which thick locations with predetermined larger diameters and with predetermined lengths, the so-called effects, are present is designated an effect yarn. The yarn sections located in between with a smaller diameter are designated webs. A specific, constantly recurring, intrinsically closed sequence of effects and webs in an alternating series of effect and web is called a yarn repeat. The repeat length is the sum of all effect lengths and web lengths. Effect yarns are becoming increasingly important. Areas of application are, for example, denim materials, materials for casual clothing and home textiles.

Effect yarns can also be produced on rotor spinning machines. In order to produce effects in the yarn on rotor spinning machines, the fiber feed to the opening roller of the rotor spinning device can be changed, for example, in that the speed of the draw-in rollers is varied.

When the thread run at open-end rotor spinning machines has been interrupted by a thread break or as a result of a cross-wound bobbin change or as a result of the cutting process after a detected, intolerable yarn defect, the thread has to be rejoined. A piecer of this type differs with regard to its diameter, in particular in the case of yarn with a diameter that remains the same, from the remaining spun yarn. The formation of piecers in rotor spinning is described, for example in DE 40 30 100 A1 or the publication, Raasch et. al. "Automatisches Anspinnen beim OE-Rotorspinnen", MELLIAND Textilberichte April 1989, pages 251 to 256.

In order to carry out the piecing process, a piecing unit which can be moved along the rotor spinning machine is generally delivered to the respective spinning station. In this case, the normal thread run is changed at the spinning station for piecing and control of the yarn formation is taken over by the piecing unit. During piecing and the subsequent run-up of the rotor, the thread can be drawn off, for example, from the spinning rotor by draw-off rollers, which are controlled by the piecing unit. Until the operating rotor speed has been reached, the take-off speed follows the increase in the rotor speed. Once the spinning rotor has reached its operating speed, the thread is returned to the normal thread run at the spinning station. With the transfer of the thread, the piecing process is ended. Control of the yarn formation is taken over again by the control device of the spinning station or the associated group control. In the known production of effect yarn on open-end rotor spinning machines, the program for forming effects also starts up again from this time. Yarn with effect formation adjoins the piecing region. The piecing region downstream from the piecer, depending on the drawing, can be several meters, with high drawings up to five meters.

SUMMARY OF THE INVENTION

The object of the invention is to improve the quality of an effect yarn, which comprises piecers.

This object is achieved by a method for producing an effect yarn on an open-end rotor spinning machine, wherein the effect yarn is formed from an alternating line-up of webs and of effects consisting of predetermined thickenings, and in which the effect yarn is reconnected by means of a piecer after yarn interruptions. According to the present invention, an effect formation is carried out in the yarn in the piecing region following the piecer, which comprises the run-up phase of the spinning rotor. The object of the invention is further achieved by an effect yarn which is formed from an alternating line-up of webs and effects consisting of predetermined thickenings, wherein the effect yarn also has effects in the piecing region of the yarn directly following a piecer.

The invention proceeds from the recognition that a yarn section with a diameter that remains the same in the finished product, for example in a woven textile, into which the effect yarn is processed, can be visually detectable and can be perceived as an imperfection, which signifies a quality defect.

Deviations from predetermined effect parameters of an effect yarn caused by piecing regions are reduced or eliminated by means of an embodiment according to the invention. The effect should be configured for this purpose at least so true to the original that disruptions owing to deviating yarn parameters can no longer be directly detected in the finished product.

According to one feature of the invention, the effect formation in the piecing region is expediently additionally controlled by the control of a piecing unit, which controls the yarn formation during the piecing process. For this purpose, only a corresponding configuration of the programming is needed. Structural changes are not necessary for this.

In a common drive of the draw-in rollers of the spinning stations, the drive coupling is separated and the drive is carried out mechanically via a drive cone directly by the piecing unit in such a way that the corresponding effects are formed.

If individual drives for the draw-in rollers are present at the spinning stations, the control thereof also directed to the effect formation can also take place from the piecing unit or also from a workstation control. The effect formation in the piecing region can thus be carried out particularly quickly and effectively.

If the effect is formed as a continuation of a yarn repeat which is discontinued owing to the yarn interruption, a good connection to the originally predetermined configuration of the effect yarn is possible.

If the effect formation begins after the piecer with the formation of a web, the checking of the piecer can take place unimpaired.

Owing to the formation of effects beginning downstream from the piecer, an effect yarn of high quality is produced with a visually advantageous, always uniformly continued alternation of effects and webs.

BRIEF DESCRIPTION OF THE DRAWINGS

The invention will be described in more detail with the aid of an embodiment. In the drawings.

DESCRIPTION OF THE PREFERRED EMBODIMENT

Figure 1:
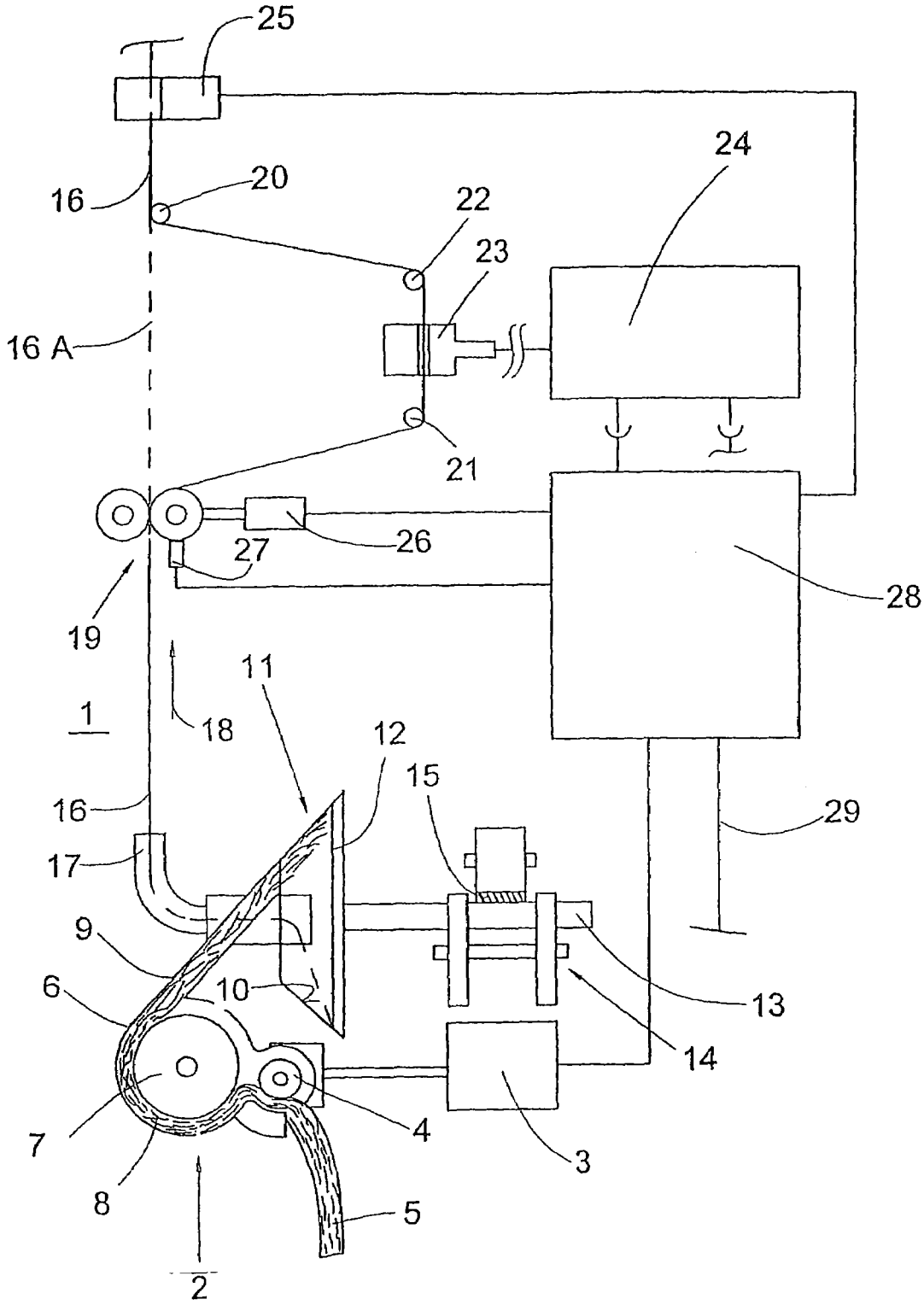
FIG. 1 shows a simplified schematic view of a workstation of an open-end rotor spinning machine.

The embodiment of FIG. 1 shows a spinning station 1 of an open-end rotor spinning machine. The spinning station 1 has an opening device 2 into which a fiber band 5 is introduced by means of the draw-in roller 4. The draw-in roller 4 is driven by the continuously adjustable draw-in motor 3. The fiber band 5 is presented to an opening roller 7 which is rotating in the housing 6 and opens the supplied fiber band 5 into individual fibers 8. The separated fibers 8 arrive through the fiber guide channel 9 onto the conical slip face 10 of a spinning rotor 11 and from there into the fiber collecting groove 12. From the fiber collecting groove 12, the yarn is drawn off through the thread draw-off tube 17 in the direction of the arrow 18 with the aid of a draw-off mechanism 19. The effects of the effect yarn 16 can be determined by corresponding activation of the draw-in motor 3. Owing to different fiber doubling in the fiber collecting groove 12, the effect yarn 16 drawn off from the fiber collecting groove 12 has the effects. The spinning rotor 11 is fastened on a shaft 13, which is mounted on a washer disc mounting 14 and is driven by means of a tangential belt 15.

The draw-off mechanism 19 for the spun yarn has a pair of rollers. During normal spinning operation, the effect yarn 16, after the draw-off mechanism 19, follows the dashed line 16A and is then wound continuously onto a cross-wound bobbin, not shown here. For piecing, a piecing unit which can be moved in each case along the rotor spinning machine is delivered to the spinning stations and carries out the piecing process. The piecing unit is not shown in more detail here for reasons of simplification.

After completion of the piecing process, a check can be made as to whether piecing has taken place properly. For this purpose, the effect yarn 16 is guided section-wise in the piecing unit, which is indicated schematically by the yarn displacement between the draw-off mechanism 19 and a thread guide 20. The effect yarn 16 runs in the piecing unit, not shown in more detail here, between two further thread guides 21 and 22 through a sensor device 23, with which the yarn diameter is continually measured during the piecing process. The checking signals for the yarn diameter measured values per unit length are supplied to a control device 24 of the piecing unit. A clearer 25 is connected in the thread run downstream from the thread guide 20. The clearer 25 comprises a sensor device and a cutting device.

If a cutting signal is triggered, the cutting device of the clearer 25 is activated and cuts the effect yarn 16.

The yarn diameter is checked during the run-up of the spinning rotor 11 at the accelerated effect yarn 16. After piecing, the effect yarn 16, corresponding to the increasing spinning rotor speed, is drawn off at an increasing speed from the thread draw-off tube 17 by means of the draw-off mechanism 19. So the measuring frequency of the sensor device 23 can be adjusted to the changing speed of the accelerated effect yarn 16, pulses are picked up by means of a sensor 27 from the thread draw-off roller of the draw-off mechanism 19 driven by a drive 26. These pulses provide information about the draw-off speed of the effect yarn 16. The sensor signals are fed to the control device 24, which controls the measuring frequency of the sensor 27 and adapts it to the yarn draw-off speed. As an alternative, the yarn speed can be determined by contactless measuring, for example, directly on the yarn. The control device 24 is connected to a control mechanism 28 of the spinning station 1. The control mechanism 28 is connected to further modules of the spinning machine via the line 29.

Further details of spinning stations of this type and the piecing process can be inferred, for example, from DE 40 30 100 A1 or the parallel U.S. Pat. No. 6,035,622 and the publication Raasch et. al. "Automatisches Anspinnen beim OE-Rotorspinnen", MELLIAND Textilberichte April 1989, pages 251 to 256.

Figure 2:
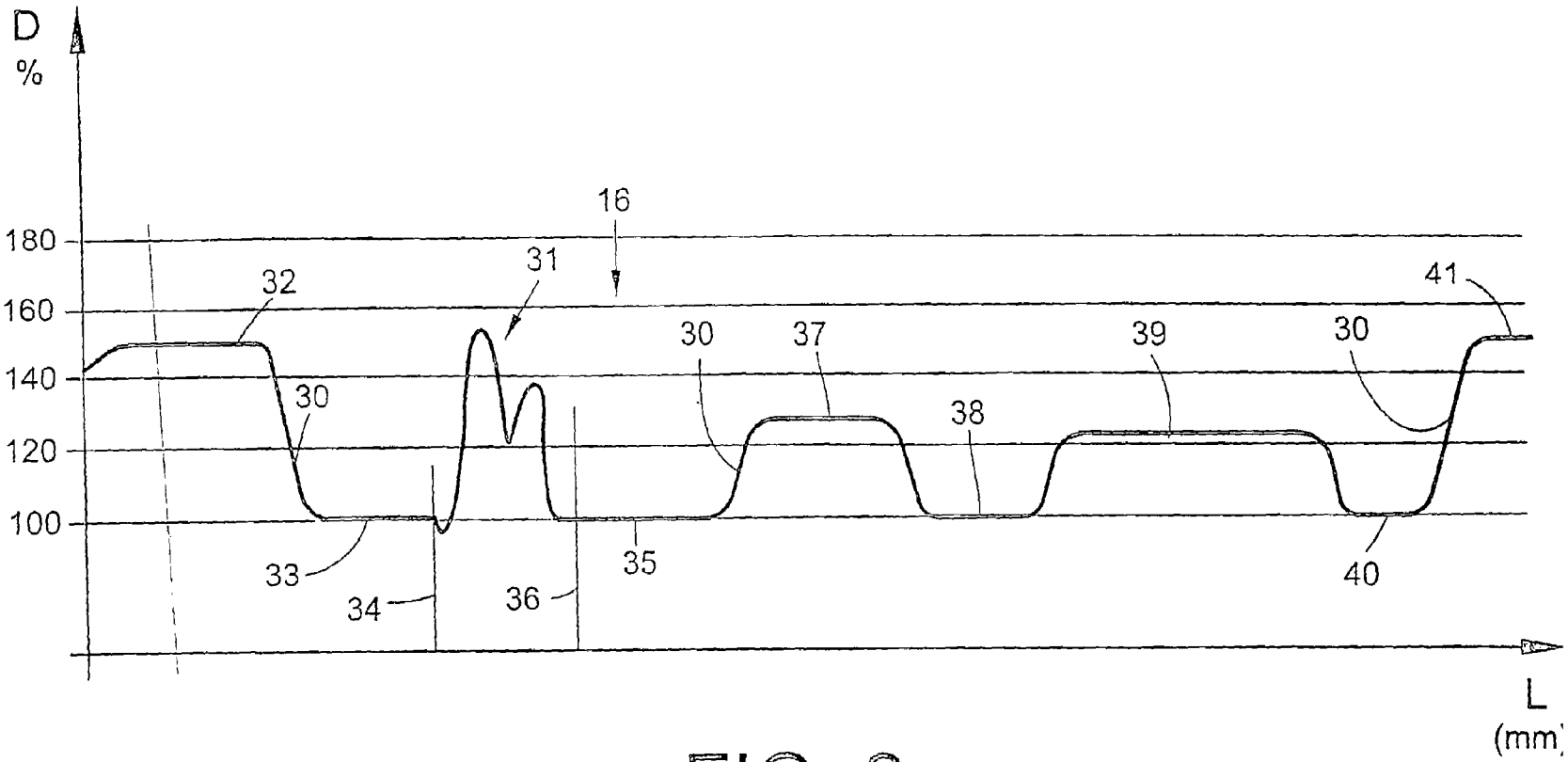
FIG. 2 shows an idealized schematic view, not to scale, of a part of an effect yarn with piecer.

FIG. 2 shows the effect yarn 16 in the form of a curve 30, which has been formed from a line-up of the continuously detected yarn diameter measured values of the effect yarn 16. In order to make the web thickness and the different effect thicknesses more recognizable, these are exaggerated in comparison to the yarn length. The diameter D of the effect yarn 16 is shown as a percentage on the ordinate of the coordinate system of FIG. 2. The value 100% corresponds to the web thickness, which is always the same in the embodiment. The yarn length L of the effect yarn 16 is given in mm on the abscissa of the coordinate system. The section represented by the course of the curve 30, of the effect yarn 16, which comprises the piecer 31, has a length of about one meter.

In FIG. 2, beginning on the left in the course of the curve 30, the last effect 32 before the end of the effect yarn 16, which has been returned for piecing, is shown. The part of the web 33 following the effect 32 has been introduced as a yarn end into the spinning rotor 11 for piecing. The effect 32 has an effect thickness of 150% of the web thickness. The line 34 indicates the location, at which the formation of the effect yarn 16 according to the specifications of the yarn repeat was interrupted. The piecer 31 then follows and subsequently the web 35. The line 36 indicates the location at which the formation of the effect yarn 16 according to the specifications of the yarn repeat was continued. Following on from the web 35 is the first effect 37 in the effect yarn 16, which has been formed as a continuation of the yarn repeat. The effect 37 has an effect thickness of 130% of the web thickness. Following on from this in the course of the effect yarn 16 shown, are the web 38 and the second effect 39. The effect 39 has an effect thickness of 125% of the web thickness. The web 40 and the third effect 41 then follow. The third effect 41 has an effect thickness of 150% of the web thickness. The web lengths of the webs 33, 35, 38, 40 and the effects 32, 37, 39, 41 are configured, like the effect thicknesses, in each case, according to the specification of the yarn repeat.

In the case of a yarn interruption, the formation of the effect yarn 16 in the spinning rotor 11 is also stopped. The yarn repeat may be stored in the control mechanism 28, for example. The location of the yarn repeat, at which the formation of the effect yarn 16 according to the specifications of the yarn repeat was interrupted, is also stored by the control mechanism 28.

After a yarn interruption, the piecing process is initiated and, during the piecing process, the fiber feed into the spinning rotor 11 is controlled via the draw-in motor 3 in such a way that the piecer 31 can be formed. The formation of the effect yarn 16 according to the specifications of the yarn repeat immediately follows the formation of the piecer 31. The effect formation can also be acted upon via the changing of further parameters, such as, for example the yarn rotation, in addition to the control of the draw-in motor 3. The formation of the effect yarn 16 according to the specifications of the yarn repeat is continued with the formation of the web, at which or before which the yarn interruption was executed.

The invention is not limited to the embodiment shown. Further embodiments are possible in the scope of the invention.

The invention claimed is:

1. Method for producing an effect yarn on an open-end rotor spinning machine, wherein the effect yarn comprises an alternating lengthwise series of webs of a predetermined smaller diameter and of effects consisting of predetermined thickenings of larger diameter relative to the webs, the method comprising the steps of reconnecting the effect yarn by means of a piecer after stoppages caused by yarn interruptions, while accelerating the spinning rotor during a run-up phase thereof to return to an operating speed, wherein a piecing region of the yarn is produced over a running yarn length of several meters following the piecer, the method being further, characterized by forming a series of webs and effects in the length of yarn produced as the piecing region of the yarn following the piecer (31) during the run-up phase of the spinning rotor (11).

2. Method according to claim 1, characterized in that the effect formation is coordinated with the run-up of the spinning rotor (11) in such a way that the same effect and web length configuration is produced as is produced during the spinning process.

3. Method according to claim 1, characterized in that the effect formation in the piecing region is controlled by a piecing unit which can be displaced along the open-end rotor spinning machine.

4. Method according to claim 1, characterized in that the effect is formed with the aid of the control of a draw-in motor (3).

5. Method according to claim 1, characterized in that the effect formation is carried out in continuation of a yarn repeat which is discontinued by the yarn interruption.

6. Method according to claim 1, characterized in that effect yarn formation after the piecer (31) begins with the configuration of a web (35).

* * * * *